US007585149B2

(12) United States Patent
Skotrikov et al.

(10) Patent No.: US 7,585,149 B2
(45) Date of Patent: Sep. 8, 2009

(54) FAN VARIABLE IMMERSION SYSTEM

(75) Inventors: Andrey Valeryevich Skotrikov, Cedar Falls, IA (US); Ronnie Franklin Burk, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 93 days.

(21) Appl. No.: 11/499,948

(22) Filed: Aug. 7, 2006

(65) Prior Publication Data

US 2008/0031721 A1 Feb. 7, 2008

(51) Int. Cl.
*F04D 29/40* (2006.01)

(52) U.S. Cl. ..... 415/126; 415/131; 454/64

(58) Field of Classification Search ..... 415/14, 415/126, 127, 128, 131, 132; 416/133, 131, 416/161, 149, 150, 186 A; 454/63, 64
See application file for complete search history.

(56) References Cited

U.S. PATENT DOCUMENTS 2,553,214 A 5/1951 Sanders
3,760,779 A 9/1973 MacLennan ..... 123/41.05
3,794,001 A 2/1974 Birch et al. ..... 123/41.05
4,329,946 A 5/1982 Longhouse ..... 123/41.49
4,413,947 A 11/1983 Seki ..... 415/182
4,539,943 A 9/1985 Tsuchikawa et al.
4,590,889 A 5/1986 Hiereth
4,685,513 A 8/1987 Longhouse et al. ..... 165/121
4,836,148 A 6/1989 Savage et al. ..... 123/41.49
5,724,826 A * 3/1998 Han ..... 62/183
6,308,665 B1 10/2001 Lewis ..... 123/41.12

FOREIGN PATENT DOCUMENTS

JP 03267520 A * 11/1991

* cited by examiner

*Primary Examiner*—Edward Look
*Assistant Examiner*—Dwayne J White

(57) ABSTRACT

A fan system includes a rotatable axial flow fan unit, a fan shroud unit adjacent to the fan unit and capable of surrounding at least a portion of an outer periphery of the fan unit; and an actuator coupled to one of the units and operable to move said one of the units with respect to the other of the units, thereby varying immersion of the fan unit within the shroud unit. The actuator may be coupled to the shroud unit and is operable to move the shroud unit with respect to the fan unit. A control unit controls the actuator to vary fan immersion as a function of sensed parameter signals, and thereby maximizes fan efficiency.

3 Claims, 2 Drawing Sheets

FAN VARIABLE IMMERSION SYSTEM

BACKGROUND

The present invention relates to a fan system including a rotating axial flow fan and a fan shroud.

Fan systems are known which include a rotating fan and a fan shroud. It is also known that the static pressure produced by a fan is a function of the immersion of the fan within the shroud, where immersion refers to how much, in the axial direction, of the outer periphery of the fan is surrounded by the fan shroud. It is also known that fan efficiency depends upon fan immersion. However, systems have not been provided for varying and controlling fan immersion.

SUMMARY

Accordingly, an object of this invention is to provide a system for reducing the level of emissions variability on engines.

A further object of the invention is to provide such a system which improves fan efficiency over a range of speeds.

These and other objects are achieved by the present invention, wherein a fan system includes a rotatable axial flow fan unit, a fan shroud unit adjacent to the fan unit and capable of surrounding at least a portion of an outer periphery of the fan unit; and an actuator coupled to one of the units and operable to move said one of the units with respect to the other of the units, thereby varying immersion of the fan unit within the shroud unit. The actuator may be coupled to the shroud unit and is operable to move the shroud unit with respect to the fan unit. A control unit controls the actuator to vary fan immersion as a function of sensed parameter signals, and thereby maximizes fan efficiency.

DETAILED DESCRIPTION

Figure 1:
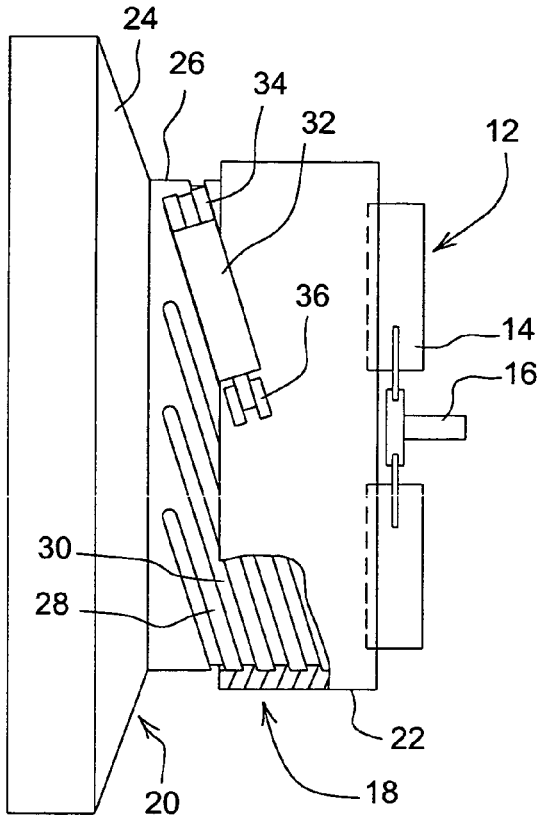
FIG. 1 is a side view of a fan assembly embodying the invention.
Figure 2:
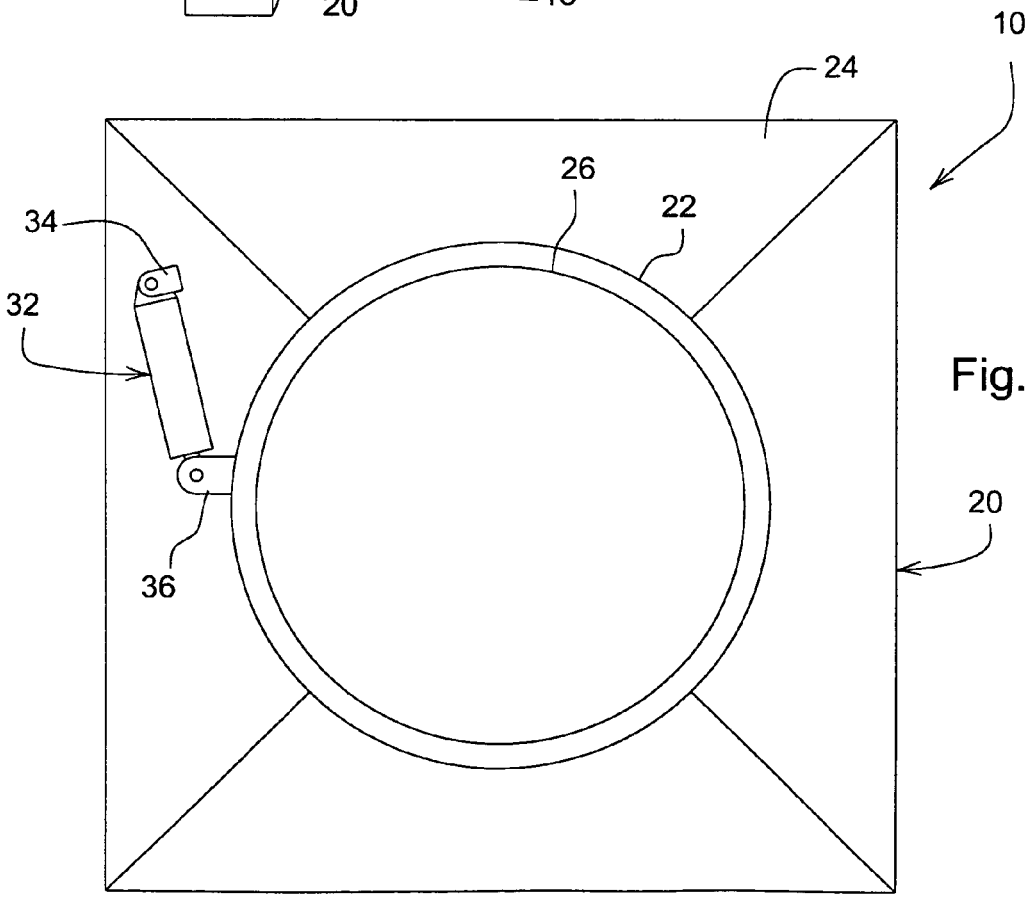
FIG. 2 is an end view of the fan assembly of FIG. 1.

Referring to FIGS. 1 and 2, a fan and shroud assembly 10 includes a fan unit 12 which has fan blades 14 mounted on a shaft 16 which is rotated by a conventional fan driving mechanism (not shown). The assembly includes a shroud assembly 18 having a first fixed shroud 20 and a movable shroud 22 coupled thereto. Shroud 20 includes a hollow larger portion 24 and a hollow smaller diameter portion 26. The larger portion 24 may be positioned to at least partially surround a heat exchange device (not shown), such as a vehicle radiator. Shroud portion 26 preferably has a set of helical threads 28 formed on its outer peripheral surface. Movable shroud 22 has a set of internal threads 30 for mating engagement with threads 28.

Figure 3:
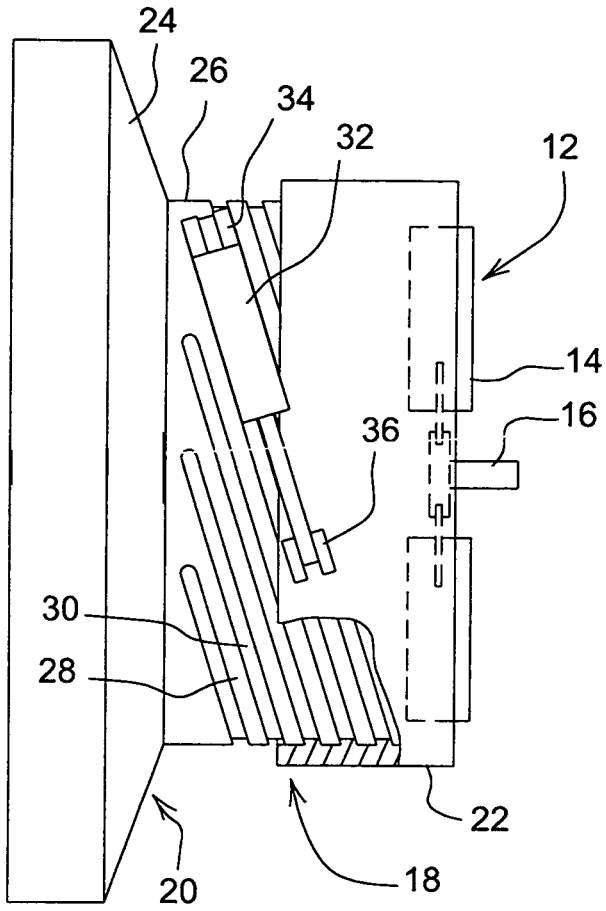
FIG. 3 is a side view of the fan assembly of FIG. 1 with the actuator extended.

An actuator 32, such as an extendable piston or hydraulic cylinder has one end coupled to a bracket 34 on shroud 20 and another end coupled to a bracket 36 mounted on shroud 22. As best seen in FIG. 1, when the actuator 32 is retracted, the shroud 22 only overlaps or surrounds a small end portion of the fan 12. As best seen in FIG. 3, when the actuator 32 is extended, the shroud 22 overlaps or surrounds a larger portion of the fan 12. Also, the hydraulic actuator 32 could be replaced with a linear electric or pneumatic actuator (not shown).

Figure 4:
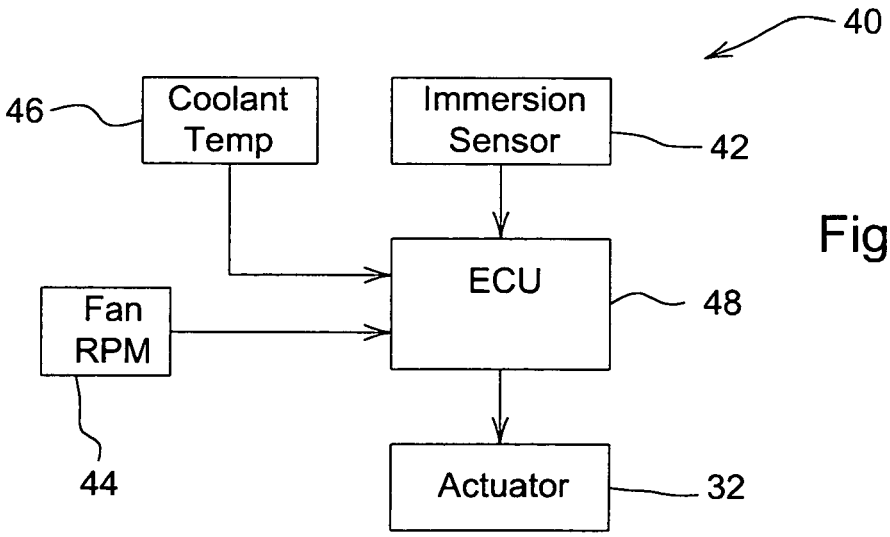
FIG. 4 is a simplified schematic diagram of a control system the fan assembly of FIG. 1.

Referring now to FIG. 4, the control system 40 includes a fan immersion sensor 42 which senses how much of the fan blades 14 are immersed in or surrounded by the shroud 22, a fan speed or rpm sensor 44, and a coolant temperature sensor 46. An electronic control unit (ECU) 48 receives signals from sensors 42-46 and generates an actuator control signal which is communicated to the actuator 32. The ECU 48 is preferably programmed with an algorithm and look-up tables in accordance with desired static pressures at different fan speeds so that the immersion can be controlled so that the fan operates at maximum efficiency under different conditions. The immersion sensor 42 may e a cylinder position sensor installed in or on the cylinder 32, or an ultrasonic position sensor installed between shroud 22 and shroud 20.

While the present invention has been described in conjunction with a specific embodiment, it is understood that many alternatives, modifications and variations will be apparent to those skilled in the art in light of the foregoing description. For example, the fan blades could be moved axially with respect to the shroud, instead of moving the shroud relative to the fan. The fan blades could be moved axially by with a sylphon type mechanism (a cylindrically symmetrical bellows), which could be heat actuated or hydraulically actuated. Accordingly, this invention is intended to embrace all such alternatives, modifications and variations which fall within the spirit and scope of the appended claims.

We claim:

1. A fan system comprising:

a rotatable axial flow fan unit;

a fan shroud unit adjacent to the fan unit and capable of surrounding at least a portion of an outer periphery of the fan unit, the shroud unit comprising a fixed shroud and a movable shroud; and an actuator, the actuator being coupled to the shroud unit and being operable to move the shroud unit with respect to the fan unit thereby varying immersion of the fan unit within the shroud unit, the actuator being coupled between the fixed shroud and the movable shroud and is operable to move the movable shroud towards and away from the fan unit, and the fixed shroud and the movable shroud each have helical thread members which engage with each other.

2. The fan system of claim 1, wherein:

a actuator comprises a hydraulic cylinder.

3. A fan system comprising:

a rotatable axial flow fan unit;

a fan shroud unit adjacent to the fan unit and capable of surrounding at least a portion of an outer periphery of the fan unit;

an actuator coupled to one of the units and operable to move said one of the units with respect to the other of the units, thereby varying immersion of the fan unit within the shroud unit;

a parameter sensor for sensing a parameter of the fan system and generating a parameter signal; and a control unit which receives the parameter signal and which is coupled to the actuator, the control unit controlling the actuator as a function of the parameter signal, the parameter sensor comprising an immersion sensor for sensing a degree of immersion of the fan unit within the shroud unit.

* * * * *